US011466822B1

(12) United States Patent
Xia

(10) Patent No.: US 11,466,822 B1
(45) Date of Patent: Oct. 11, 2022

(54) LIGHT-EMITTING LAMP STRING WIRE

(71) Applicant: Dongguan Gaitewei Lighting Co., Ltd., Dongguan (CN)

(72) Inventor: Xiaohuan Xia, Dongguan (CN)

(73) Assignee: Dongguan Gaitewei Lighting Co., Ltd., Dongguan (CN)

( * ) Notice: Subject to any disclaimer, the term of this patent is extended or adjusted under 35 U.S.C. 154(b) by 0 days.

(21) Appl. No.: 17/499,876

(22) Filed: Oct. 13, 2021

(30) Foreign Application Priority Data

Oct. 11, 2021 (CN) ..... 202111180483.4

(51) Int. Cl.

| | |
|---|---|
| ***F21S 4/10*** | (2016.01) |
| ***F21S 10/02*** | (2006.01) |
| ***F21V 19/00*** | (2006.01) |
| ***F21V 23/06*** | (2006.01) |
| *F21Y 115/10* | (2016.01) |

(52) U.S. Cl.
CPC ..... *F21S 4/10* (2016.01); *F21S 10/02* (2013.01); *F21V 19/0075* (2013.01); *F21V 23/06* (2013.01); *F21Y 2115/10* (2016.08)

(58) Field of Classification Search
CPC ..... F21S 4/10; F21V 23/06
See application file for complete search history.

(56) References Cited

U.S. PATENT DOCUMENTS

| | | | | |
|---|---|---|---|---|
| 2009/0085487 | A1* | 4/2009 | Braasch | F21S 4/10 315/185 S |
| 2010/0289415 | A1* | 11/2010 | Chen | F21S 4/10 315/185 R |
| 2014/0340903 | A1* | 11/2014 | Mahr | F21V 23/001 362/249.08 |
| 2015/0192285 | A1* | 7/2015 | Chen | F21S 4/10 315/185 R |
| 2018/0202619 | A1* | 7/2018 | Dedene | F21V 23/06 |

* cited by examiner

*Primary Examiner* — Evan P Dzierzynski
(74) *Attorney, Agent, or Firm* — Hawaii Patent Services; Nathaniel K. Fedde; Kenton N. Fedde

(57) ABSTRACT

The present invention relates to the field of lighting, and in particular to a light-emitting lamp string wire, wherein the light-emitting lamp string wire comprises a lamp string wire male connector, a lamp string wire female connector, and bulb power cords and copper wire lamp power cords installed between the lamp string wire male connector and the lamp string wire female connector, wherein the bulb power cords are connected in parallel with several bulbs, and the copper wire lamp power cords are connected in parallel with several LED lamp beads. With the present invention, light-emitting modes of the bulbs and said several LED lamp beads can be synchronous switched and colors thereof can be synchronous changed; a connection way of two strands of power cords effectively avoids a problem of a significant difference in brightness of front and rear lamp beads because the copper wire lamp core wires are too thin and there is a large front and rear voltage drop; and, both power control and solar control are considered. Therefore, the light-emitting lamp string wire is more beautiful, more ornamental, easier to install, and more widely used.

10 Claims, 6 Drawing Sheets

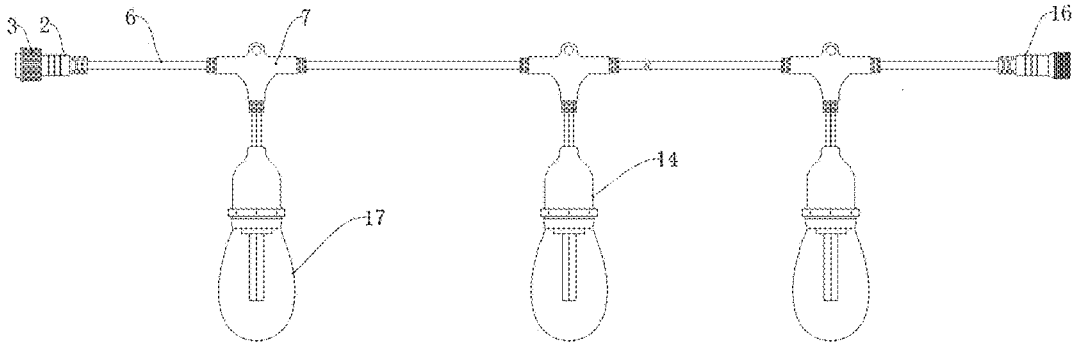
1
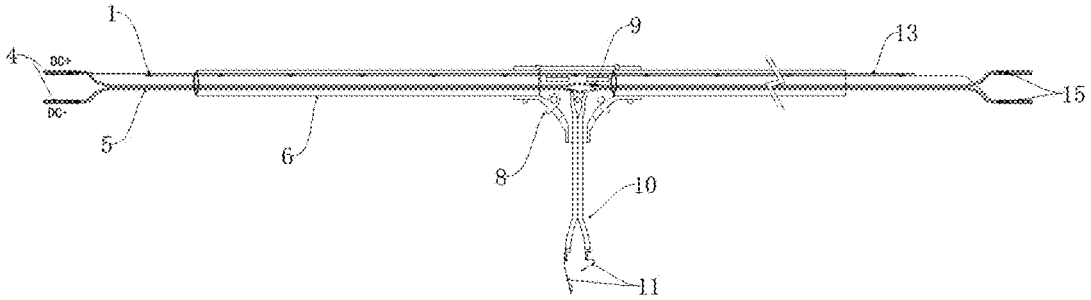
2
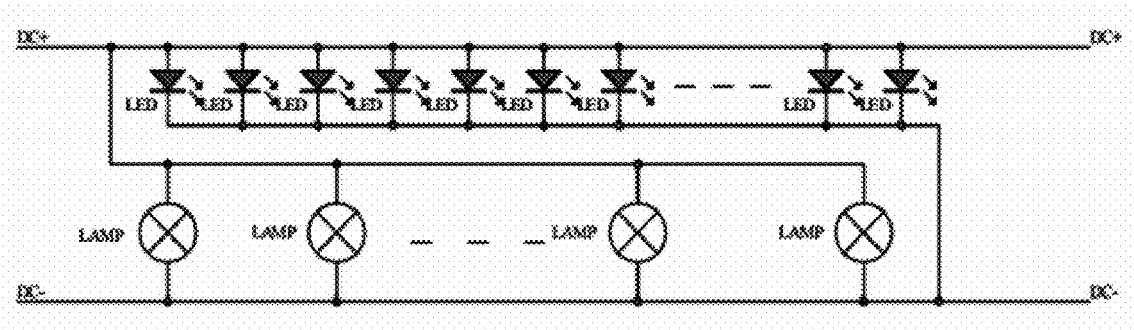
3
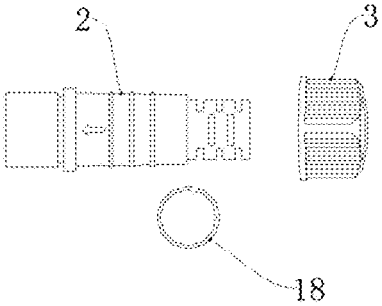
4

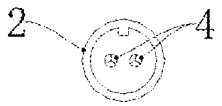
5
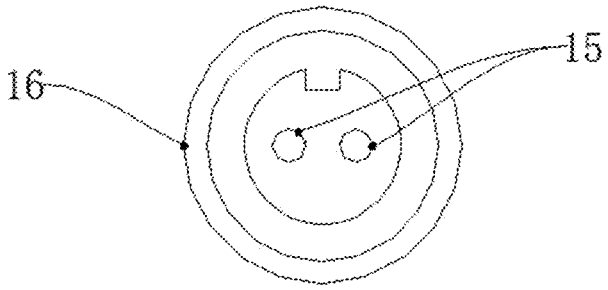
6
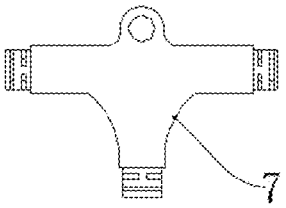
7

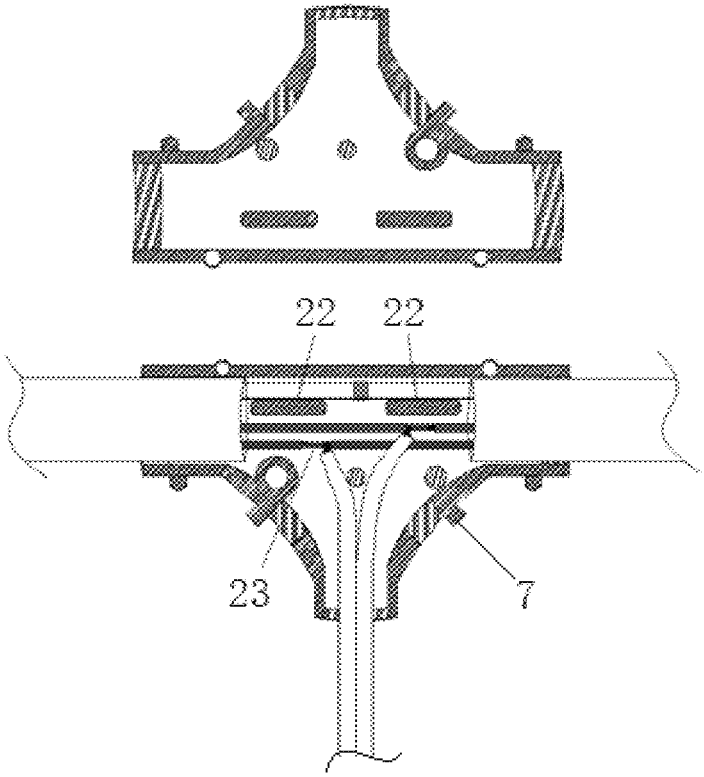
8
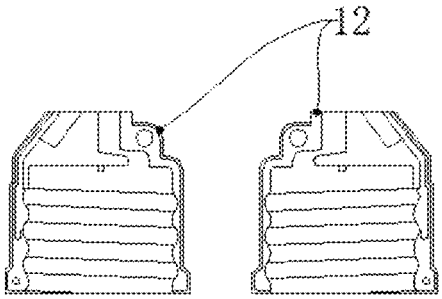
9

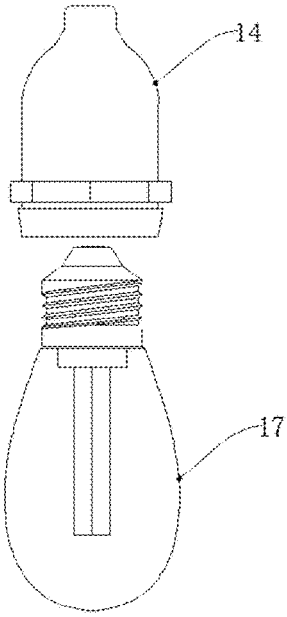
10
8
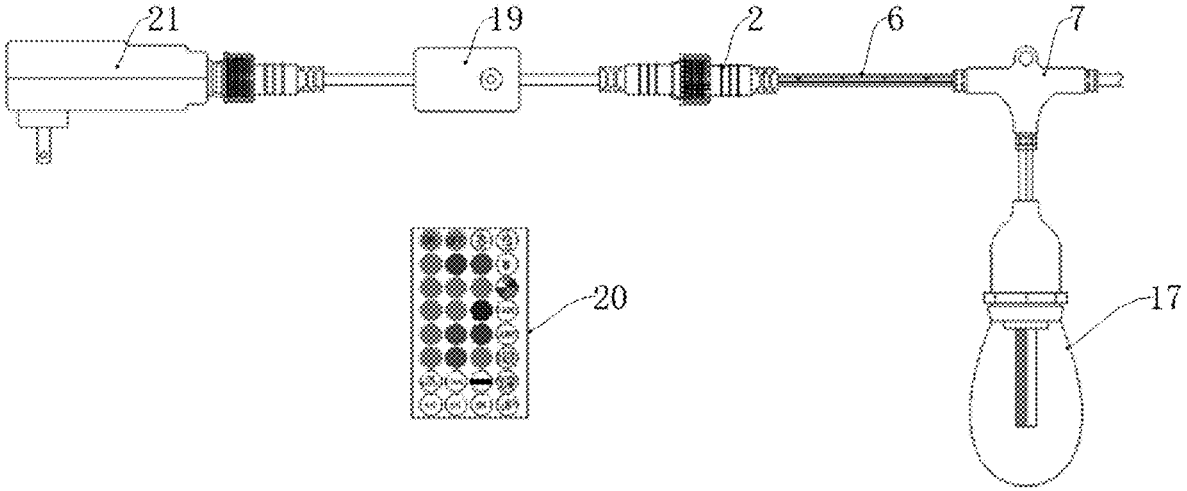
11

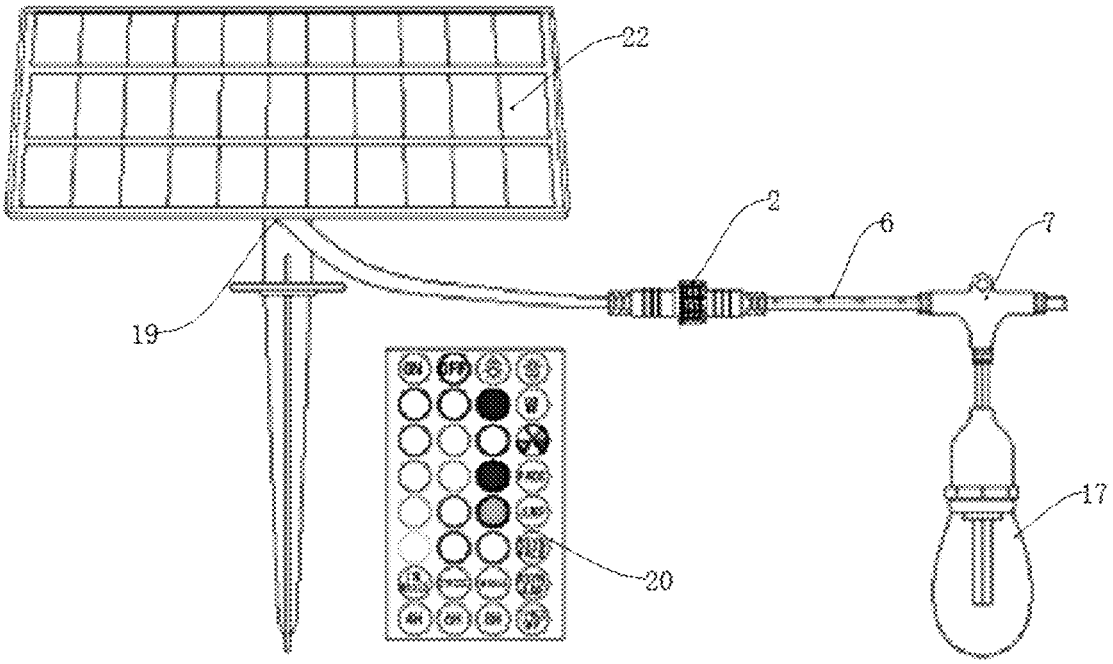
12
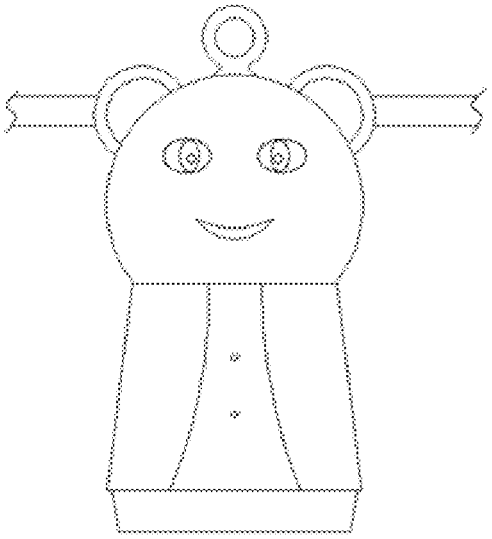
13

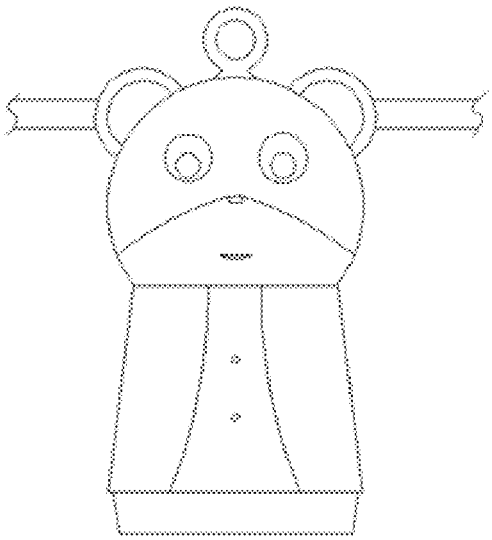
14

LIGHT-EMITTING LAMP STRING WIRE

TECHNICAL FIELD

The present invention relates to the field of lighting, and in particular to light-emitting lamp string wire.

BACKGROUND

Decorative lamps are indispensable electronic decoration products for homes, festivals, and night scene decorations in public places, and market scale thereof is extremely large, wherein lamp string wire is one of lighting decoration products widely used by domestic and foreign users.

However, the existing lamp string product generally uses LED lamps inside a PVC tube to make the tube emit light, or connects lamp holders to power cords to make bulbs emit light. The production process thereof generally needs to first squeeze an independent core wire. A main power cord is inserted in the core wire. As a result, the existing lamp string product can only achieve a single light emission, and cannot achieve the simultaneous light emissions of the lamp string wire and the bulbs and realize simultaneous switching of colors and modes. When multiple power cords are used, it is also easy to cause a significant difference in the brightness of a front and rear lamp beads because the core wires of the copper wire lamp on the power cords are too thin, and a front and the rear voltage drop is large.

SUMMARY

In view of the deficiencies in the prior art, the purpose of the embodiments in the present invention is to provide a light-emitting lamp string wire to solve the above-mentioned problems in the background art.

In order to achieve the above objects, the present invention provides the following technical solutions:

A light-emitting lamp string wire, comprising a lamp string wire male connector, a lamp string wire female connector, and bulb power cords and copper wire lamp power cords installed between the lamp string wire male connector and the lamp string wire female connector, wherein the bulb power cords are connected in parallel with several bulbs, and the copper wire lamp power cords are connected in parallel with several LED lamp beads; a positive electrode of the copper wire lamp power cords and a positive electrode of the bulb power cords are both connected to a positive electrode of the lamp string wire male connector, and the negative electrode of the bulb power cords is separately connected to a negative electrode of the lamp string wire male connector; and, a negative electrode of the copper wire lamp power cords and the negative electrode of the bulb power cords are both connected to a negative electrode of the lamp string wire female connector, and the negative electrode of the bulb power cords is separately connected to a positive electrode of the lamp string wire female connector.

In the present invention, two strands of power cords are connected to the lamp string wire male connector and the lamp string wire female connector, wherein one strand of the bulb power cords is connected to the bulbs and another strand of the copper wire lamp power cords is connected to said several LED lamp beads, so as to realize synchronous switching of light-emitting modes of the bulbs and said several LED lamp beads and synchronous changes of colors thereof. A connection way of the two strands of the power cords effectively avoids a problem of a significant difference in brightness of front and rear lamp beads because core wires of the copper wire lamps are too thin and there is a large front and rear voltage drop. Therefore, the light-emitting lamp string wire is more beautiful, more ornamental, easier to install, and more widely used.

As a further solution of the present invention, two male copper nails are embedded in the lamp string wire male connector, which respectively serve as positive and negative terminals of the lamp string wire male connector; the lamp string wire male connector is sleeved with a nut buckle, and the nut buckle is used to connect the lamp string wire male connector with a lamp string wire female connector of another light-emitting lamp string wire in series.

As a further solution of the present invention, two female copper tubes are embedded in the lamp string wire female connector, which respectively serve as positive and negative terminals of the lamp string wire female connector. the lamp string wire female connector is provided with an external thread which is connected with the nut buckle. By connecting through the lamp string wire male connector and the lamp string wire female connector, it is convenient to connect several lighting lamp string wires end to end, so as to extend the length of the lighting lamp string wire for deployment in various occasions.

As a further solution of the present invention, the bulb power cords and the copper wire lamp power cords are both wrapped in a transparent tube between the lamp string wire male connector and the lamp string wire female connector; the copper wire lamp power cords are composed of double parallel wires consisted of two, positive and negative, strands of enameled copper wires; and, said several LED lamp beads are distributed along the interior of the transparent tube in an equal interval and connected between the two, positive and negative, strands of the enameled copper wires.

As a further solution of the present invention, the bulb power cords are double parallel wires consisted of two, positive and negative, strands of power cords, and the bulb is connected to the corresponding lamp holder assembly, and the lamp holder assembly is respectively electrically connected to the double parallel wires of the bulb power cords through two, positive and negative, strands of the corresponding lamp holder wires.

As a further solution of the present invention, a T-shaped injection molded part is installed on the transparent tube at the corresponding joint of the lamp holder wires and the double parallel wires of the bulb power cords; a T-shaped bracket for wiring of the lamp holder wires and the power cords in the transparent tube is formed in the corresponding T-shaped injection molded part; and the lamp holder assembly is arranged in the corresponding lamp holder injection molded part, and the lamp holder assembly is electrically connected with two, positive and negative, pieces of lamp holder shrapnel of the two strands of the corresponding lamp holder wires, respectively. The T-shaped injection molded part is used for simple assembly, which is convenient to fix the two strands of the lamp holder wires after being led out from the bulb power cords of the transparent tube, protect the joint, avoid the joint to be exposed, and improve the safety of the light-emitting lamp string wire.

As a further solution of the present invention, a connection port at a joint of the two, positive and negative, strands of the lamp holder wires and the double parallel wires of the bulb power cords is arranged in the T-shaped bracket; the lamp holder wires and the bulb power cords are fixed with copper tape at the connection port; a blocking block is also arranged between the bulb power cords and the copper wire lamp power cords in the T-shaped bracket, so as to separate the bulb power cords from the copper wire lamp power cords to prevent a short circuit between the two strands of the power cords.

As a further solution of the present invention, the lamp holder assembly is a pattern shape on the transparent tube installed between the lamp string wire male connector and the lamp string wire female connector; the lamp holder assembly is electrically connected to the double parallel wires of the bulb power cords through the two, positive and negative, strands of the corresponding lamp holder wires, respectively; the lamp holder assembly is connected to the corresponding bulb and the shape thereof can be changed and is not limited to a shape of the T-shaped injection molded part, and various shapes of animals such as a tiger, a panda, a small raccoon, a sheep, a sika deer, etc. or other shapes can be used, which is more beautiful than a traditional lamp holder.

As a further solution of the present invention, it further comprises a controller connected to the light-emitting lamp string wire; the controller is connected to a power adapter or a solar panel; the controller is used to control the LED lamp beads and the bulbs of the light-emitting lamp string wire to switch modes and change colors synchronously, and the controller wirelessly communicates with a remote control, so it is convenient to switch the colors and modes of the light-emitting light string through the controller and/or the remote control's own buttons, as well as to set the timing, adjust the brightness, select the mode, select the color, etc. Both the power adapter and the solar panel are considered by the light-emitting lamp string wire to make the light-emitting lamp string wire more beautiful, more ornamental, easier to install, and be more widely used.

As a further solution of the present invention, each of the LED lamp beads and the bulbs is integrated with an MCU wafer, and the MCU wafer is used to receive a signal transmitted by the controller so as to control the LED lamp beads and the bulbs to switch modes and change colors synchronously.

In summary, compared with the prior art, the embodiments of the present invention have the following beneficial effects:

For the light-emitting lamp string wire in the present invention, the two strands of the power cords are connected to the lamp string wire male connector and the lamp string wire female connector which are at two ends of the transparent tube, wherein one strand of the bulb power cords is connected to the bulbs and another strand of copper wire lamp power cords is connected to said several LED lamp beads, so as to realize the synchronous switching of light-emitting modes of the bulbs and said several LED lamp beads and the synchronous changes of colors thereof, wherein a connection way of the two strands of power cords effectively avoids a problem of a significant difference in brightness of front and rear lamp beads because core wires of the copper wire lamps are too thin and there is a large front and rear voltage drop, so as to make the light-emitting lamp string wire more beautiful, more ornamental, easier to install, and be more widely used.

In order to illustrate the structural features and effects of the present invention more clearly, the present invention will be described in detail below with reference to the accompanying drawings and specific embodiments.

BRIEF DESCRIPTION OF THE DRAWINGS

FIG. 1 is a schematic structural diagram of a light-emitting lamp string wire according to an embodiment of the present invention.

FIG. 2 is a schematic diagram of a cross-sectional structure of the light-emitting lamp string wire in the embodiment of the present invention in FIG. 1.

FIG. 3 is a circuit diagram of a light-emitting lamp string wire according to an embodiment of the present invention.

FIG. 4 is a schematic diagram of disassembling a lamp string wire male connector of a light-emitting lamp string wire according to an embodiment of the present invention.

FIG. 5 is a schematic structural diagram of an end face of a lamp string wire male connector in a light-emitting lamp string wire according to an embodiment of the present invention.

FIG. 6 is a schematic structural diagram of an end face of a lamp string wire female connector in a light-emitting lamp string wire according to an embodiment of the present invention.

FIG. 7 is a schematic structural diagram of a T-shaped injection molded part in a light-emitting lamp string wire according to an embodiment of the present invention.

FIG. 8 is a schematic structural diagram of a T-shaped bracket for a lamp holder in a light-emitting lamp string wire according to an embodiment of the present invention.

FIG. 9 is a schematic structural diagram of the interior of a lamp holder assembly in a light-emitting lamp string wire according to an embodiment of the present invention.

FIG. 10 is a schematic structural diagram of a bulb in a light-emitting lamp string wire according to an embodiment of the present invention.

FIG. 11 is a schematic structural diagram of a light-emitting lamp string wire of a plug-in type according to an embodiment of the present invention.

FIG. 12 is a schematic structural diagram of a light-emitting lamp string wire of a solar-powered type according to an embodiment of the present invention.

FIG. 13 is a schematic structural diagram of a bulb of a panda shape in a light-emitting lamp string wire according to an embodiment of the present invention.

FIG. 14 is a schematic structural diagram of a bulb of a small raccoon shape in a light-emitting lamp string wire according to an embodiment of the present invention.

Reference numbers: 1—LED lamp beads, 2—lamp string wire male connector, 3—nut buckle, 4—male copper nails, 5—double parallel wires, 6—transparent tube, 7—T-shaped injection molded part, 8—T-shaped bracket, 9—copper tape, 10—lamp holder wires, 11—lamp holder shrapnel, 12—lamp holder assembly, 13—enameled copper wires, 14—lamp holder injection molded part, 15—female copper tube, 16—lamp string wire female connector, 17—bulb, 18—waterproof rubber ring, 19—controller, 20—remote control, 21—power adapter, 22—solar panel, 23—connection port, 24—blocking block.

DETAILED DESCRIPTION OF THE EMBODIMENTS

In order to facilitate the understanding of this application, the following will give a more comprehensive description of this application with reference to the relevant drawings. The preferred embodiments of the present application are shown in the accompanying drawings. However, this application can be implemented in many different forms and is not limited to the embodiments described herein. On the contrary, the purpose of providing these embodiments is to make the disclosure of this application more thorough and comprehensive.

The technical solutions of the present invention will be further described below in conjunction with the drawings and specific embodiments.

Referring to FIG. 1 and FIG. 2, an embodiment of the present invention provides a light-emitting lamp string wire, wherein the light-emitting lamp string wire comprises a lamp string wire male connector 2, a lamp string wire female connector 16, and bulb power cords and copper wire lamp power cords installed between the lamp string wire male connector 2 and the lamp string wire female connector 16. Referring to FIG. 2 and FIG. 3, a positive electrode of the copper wire lamp power cords and a positive electrode of the bulb power cords are both connected to a positive electrode of the lamp string wire male connector 2, and the negative electrode of the bulb power cords is separately connected to a negative electrode of the lamp string wire male connector 2; and, a negative electrode of the copper wire lamp power cords and the negative electrode of the bulb power cords are both connected to a negative electrode of the lamp string wire female connector 16, and the negative electrode of the bulb power cords is separately connected to a positive electrode of the lamp string wire female connector 16.

The bulb power cords are connected in parallel with several bulbs 17, and the copper wire lamp power cords are connected in parallel with several LED lamp beads 1. In this embodiment, the above-mentioned connection way avoids a problem of a significant difference in brightness of front and rear lamp beads because core wires of the copper wire lamps are too thin and there is a large front and rear voltage drop.

In an embodiment of the present invention, the bulb power cords and the copper wire lamp power cords are both wrapped in a transparent tube 6 between the lamp string wire male connector 2 and the lamp string wire female connector 16, wherein, said several LED lamp beads 1 are distributed along the interior of the transparent tube 6 in an equal interval and connected between two, positive and negative, strands of enameled copper wires 13. Said several bulbs 17 are distributed along the exterior of the transparent tube 6 in an equal interval and connected to double parallel wires 5 composed of the two, positive and negative, strands of the enameled copper wires 13 of the copper wire lamp power cords through the lamp holder assemblies 12, respectively. In this way, the insulation of the bulb power cords and the copper wire lamp power cords can be ensured, and the light-emitting effect of said several LED lamp beads 1 located in the transparent tube 6 can be ensured.

In an embodiment of the present invention, referring to FIG. 1, FIG. 2, FIG. 4 and FIG. 5, two male copper nails 4 are embedded in the lamp string wire male connector 2, which respectively serve as positive and negative terminals of the lamp string wire male connector 2; the lamp string wire male connector 2 is sleeved with a nut buckle 3, and the nut buckle 3 is used to connect the lamp string wire male connector 2 with a lamp string wire female connector 16 of another light-emitting lamp string wire in series.

Referring to FIG. 2 and FIG. 6, two female copper tubes 15 are embedded in the lamp string wire female connector 16, which respectively serve as positive and negative terminals of the lamp string wire female connector 16; and, the lamp string wire female connector 16 is provided with an external thread connected with the nut buckle 3. In this embodiment, when two light-emitting lamp string wires need to be joined into a longer light-emitting lamp string wire, the nut buckle 3 is used to connect, end to end, the lamp string wire male connector 2 and the lamp string wire female connector 16 of two adjacent light-emitting lamp string wires, wherein, the light string male connector 2 is also sleeved with a waterproof rubber ring 18. When the nut buckle 3 is connected with the external thread of the lamp string wire female connector 16 of another light-emitting lamp string wire, the nut buckle 3 abuts the waterproof rubber ring 18 of the lamp string wire male connector 2 to ensure a sealing effect between the connected lamp string wire male connector 2 and lamp string wire female connector 16 and improve the waterproof effect between the lamp string wire male connector 2 and the lamp string wire female connector 16.

In an embodiment of the present invention, referring to FIG. 1, FIG. 2, FIG. 7 to FIG. 10, a T-shaped injection molded part 7 is installed on the transparent tube 6 at the corresponding joint of the lamp holder wires 10 and the double parallel wires 5 of the bulb power cords; a T-shaped bracket 8 for wiring of the lamp holder wires 10 and the power cords in the transparent tube 6 is formed in the corresponding T-shaped injection molded part 7. The lamp holder assemblies 12 is arranged in the lamp holder injection molded part 14, and the lamp holder assembly 12 is electrically connected with two, positive and negative, pieces of lamp holder shrapnel 11 of two strands of the lamp holder wires 10, respectively.

In this embodiment, a connection port 23 at the joint of the two, positive and negative, strands of the lamp holder wires 10 and the double parallel wires 5 of the bulb power cords are arranged in the T-shaped bracket 8. The lamp holder wires 10 and the bulb power cords are fixed with copper tape 9 at the connection port 23. A blocking block 24 is also arranged between the bulb power cords and the copper wire lamp power cords in the T-shaped bracket 8.

When installing the bulb 17 on the corresponding lamp holder assembly 12, first connecting the two, positive and negative, strands of the power cords through two strands of the lamp holder wires 10 and the bulb power cords, and using the T-shaped injection molded part 7 to protect a joint location to form an insulating shell at the joint location. In addition, a blocking block 24 is arranged inside the T-shaped injection molded part 7 to block the bulb power cords and the copper wire lamp power cords so as to prevent a short-circuit between the two strands of power cords. The T-shaped injection molded part 7 functions to fix the lamp holder assembly 12 and a lamp string wire terminal. Referring to FIG. 8, the T-shaped injection molded part 7 is easy to install. By alignment of positioning posts and positioning holes, the two parts of the T-shaped injection part 7 can be assembled tightly to complete the complete assembly of the T-shaped injection part 7. Any two symmetrically arranged parts of the T-shaped injection part 7 can be buckled together, so as to form the complete T-shaped bracket 8 and contribute to the barrier to prevent two cords from being short-circuited.

The lamp holder wire 10 and the bulb power cords at the connection port 23 are fixed with the copper tape 9 to ensure the firmness of the joint and easy operation.

In another embodiment of the present invention, the lamp holder assembly 12 is a pattern shape on the transparent tube 6 installed between the lamp string wire male connector 2 and the lamp string wire female connector 16; the lamp holder assembly 12 is electrically connected to the double parallel wires 5 of the bulb power cords through the two, positive and negative, strands of the lamp holder wires 10, respectively; the lamp holder assembly 12 is connected to the corresponding bulb 17. Referring to FIG. 13 and FIG. 14, the pattern shape of the lamp holder assembly 12 may be various shapes of animals such as a tiger, a panda, a small raccoon, a sheep, a sika deer, etc. or other shapes, which is more beautiful than a traditional lamp holder.

In an embodiment of the present invention, referring to FIG. 11, the light-emitting lamp string wire is connected to a controller 19, and the controller 19 is connected to a power adapter 21 and wirelessly communicates with a remote control 20. In this embodiment, the power adapter 21, the controller 19, and the light-emitting lamp string wire are connected to form a plug-in type light-emitting lamp string wire. When in use, the controller 19 has its own buttons to switch color and mode of the bulbs 17 and the LED lamp beads 1 on the light-emitting lamp string wire, and the remote control 20 is supported to set timing, adjust brightness, select mode, select color, etc. Preferably, the power adapter 21 is a 110 V-240 V power adapter, which can be directly connected to the mains. The controller 19 is an RF controller, which can remotely switch the color and mode of the light-emitting lamp string wire at a short distance.

In an embodiment of the present invention, referring to FIG. 12, the light-emitting lamp string wire is connected to the controller 19; the controller 19 is connected to a solar panel 22; and, the controller 19 is used to control the LED lamp beads 1 and the bulbs 17 of the light-emitting lamp string wire to switch modes and change colors synchronously, and the controller 19 wirelessly communicates with a remote controller 20. In this embodiment, the solar panel 22, the controller 19, and the light-emitting lamp string wire are connected to form a light-emitting lamp string wire of a solar-powered type. When in use, the controller 19 has its own buttons to switch the color and mode of the bulbs 17 and the LED lamp beads 1 on the light-emitting lamp string wire, and supports the remote control 20 to set timing, adjust brightness, select mode, select color, etc. Preferably, the power adapter 21 is a 110 V-240 V power adapter, which can be directly connected to the mains. The controller 19 is the RF controller, which can remotely switch the color and mode of the light-emitting lamp string wire at a short distance.

In the present invention, each of the LED lamp beads 1 and the bulbs 17 is integrated with an MCU wafer, and the MCU wafer is used to receive a signal transmitted by the controller 19 so as to control the LED lamp beads 1 and the bulbs 17 to switch modes and change colors synchronously. The integrated MCU wafer controls each color to make the corresponding action by receiving the signal from the controller 19. This method saves peripheral elements, saves space, and makes application easier.

In summary, the light-emitting lamp string wire of the present invention can realize light-emitting modes such as RGB, warm white, cool white, cool white and warm white, and can make the LED lamp beads 1 and the bulbs 17 change colors synchronously and switch modes synchronously. The lamp holder assemblies 12 can have a variety of animal pattern shapes, and the light-emitting lamp string wire of the present invention can take into account power control and solar control. Therefore, the light-emitting lamp string wire is more beautiful, more ornamental, easier to install, and more widely used.

The technical principles of the present invention are described above in combination with specific embodiments, which are only preferred implementations of the present invention. The protection scope of the present invention is not only limited to the above-mentioned embodiments, and all technical solutions that fall into the concepts of the present invention belong to the protection scope of the present invention. A person skilled in the art can think of other specific implementations of the present invention without creative work, and these implementations will all fall into the protection scope of the present invention.

The invention claimed is:

1. A light-emitting lamp string wire, wherein the light-emitting lamp string wire comprises a lamp string wire male connector (2), a lamp string wire female connector (16), and bulb power cords and copper wire lamp power cords installed between the lamp string wire male connector (2) and the lamp string wire female connector (16), wherein the bulb power cords are connected in parallel with several bulbs (17), and the copper wire lamp power cords are connected in parallel with several LED lamp beads (1); a positive electrode of the copper wire lamp power cords and a positive electrode of the bulb power cords are both connected to a positive electrode of the lamp string wire male connector (2), and the negative electrode of the bulb power cords is separately connected to a negative electrode of the lamp string wire male connector (2); and, a negative electrode of the copper wire lamp power cords and the negative electrode of the bulb power cords are both connected to a negative electrode of the lamp string wire female connector (16), and the negative electrode of the bulb power cords is separately connected to a positive electrode of the lamp string wire female connector (16).

2. The light-emitting lamp string wire according to claim 1, wherein two male copper nails (4) are embedded in the lamp string wire male connector (2), which respectively serve as positive and negative terminals of the lamp string wire male connector (2); and, the lamp string wire male connector (2) is sleeved with a nut buckle (3), and the nut buckle (3) is used to connect the lamp string wire male connector (2) with a lamp string wire female connector (16) of another light-emitting lamp string wire in series.

3. The light-emitting lamp string wire according to claim 2, wherein two female copper tubes (15) are embedded in the lamp string wire female connector (16), which respectively serve as positive and negative terminals of the lamp string wire female connector (16); and, the lamp string wire female connector (16) is provided with an external thread connected with the nut buckle (3).

4. The light-emitting lamp string wire according to claim 1, wherein the bulb power cords and the copper wire lamp power cords are both wrapped in a transparent tube (6) between the lamp string wire male connector (2) and the lamp string wire female connector (16); the copper wire lamp power cords are composed of double parallel wires (5) consisted of two, positive and negative, strands of enameled copper wires (13); and, said several LED lamp beads (1) are distributed along the interior of the transparent tube (6) in an equal interval and connected between the two, positive and negative, strands of the enameled copper wires (13).

5. The light-emitting lamp string wire according to claim 4, wherein the bulb power cords are double parallel wires (5) consisted of two, positive and negative, strands of power cords; each of the bulbs (17) is connected to the corresponding lamp holder assembly (12); and, the lamp holder assembly (12) is respectively electrically connected to the double parallel wires (5) of the bulb power cords through two, positive and negative, strands of lamp holder wires (10).

6. The light-emitting lamp string wire according to claim 5, wherein a T-shaped injection molded part (7) is installed on the transparent tube (6) at the corresponding joint of the lamp holder wires (10) and the double parallel wires (5) of the bulb power cords; a T-shaped bracket (8) for wiring of the lamp holder wires (10) and the power cords in the transparent tube (6) is formed in the corresponding T-shaped injection molded part (7); and, the lamp holder assembly (12) is arranged in the lamp holder injection molded part (14), and the lamp holder assembly (12) is electrically connected with two, positive and negative, pieces of lamp holder shrapnel (11) of the two strands of the lamp holder wires (10), respectively.

7. The light-emitting lamp string wire according to claim 6, wherein a connection port (23) at the corresponding joint of the two, positive and negative, strands of the lamp holder wires (10) and the double parallel wires (5) of the bulb power cords is arranged in the T-shaped bracket (8); the lamp holder wires (10) and the bulb power cords are fixed with copper tape (9) at the connection port (23); a blocking block (24) is also arranged between the bulb power cords and the copper wire lamp power cords in the T-shaped bracket (8).

8. The light-emitting lamp string wire according to claim 5, wherein the lamp holder assembly (12) is a pattern shape on the transparent tube (6) installed between the lamp string wire male connector (2) and the lamp string wire female connector (16); the lamp holder assembly (12) is electrically connected to the double parallel wires (5) of the bulb power cords through the two, positive and negative, strands of the corresponding lamp holder wires (10), respectively; and, the lamp holder assembly (12) is connected to the corresponding bulb (17).

9. The light-emitting lamp string wire according to claim 1, wherein the light-emitting lamp string wire further comprises a controller (19) connected to the light-emitting lamp string wire; the controller (19) is connected to a power adapter (21) or a solar panel (22); and, the controller (19) is used to control the LED lamp beads (1) and the bulbs (17) of the light-emitting lamp string wire to switch modes and change colors synchronously, and the controller (19) wirelessly communicates with a remote control (20).

10. The light-emitting lamp string wire according to claim 9, wherein each of the LED lamp beads (1) and the bulbs (17) is integrated with an MCU wafer, and the MCU wafer is used to receive a signal transmitted by the controller (19) so as to control the LED lamp beads (1) and the bulbs (17) to switch modes and change colors synchronously.

* * * * *